US006386556B1

(12) United States Patent
Yeh

(10) Patent No.: US 6,386,556 B1
(45) Date of Patent: May 14, 2002

(54) ROLLER SKATE

(76) Inventor: Chin-Ho Yeh, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/755,315

(22) Filed: Dec. 29, 2000

(51) Int. Cl.[7] ..... A63C 17/20

(52) U.S. Cl. ..... 280/11.223; 280/11.27; 280/7.13; 280/11.233

(58) Field of Search ..... 280/11.27, 11.19, 280/11.233, 11.25, 11.26, 7.13, 11.204, 11.223, 11.231, 11.221

(56) References Cited

U.S. PATENT DOCUMENTS 2,058,164 A * 10/1936 Marx ..... 208/173
2,095,942 A * 10/1937 Wetterstrand ..... 36/2.5
2,117,785 A * 5/1938 Becker ..... 280/11.19
3,884,485 A * 5/1975 Walle ..... 280/841
3,979,842 A * 9/1976 Texidor ..... 36/115
3,983,643 A * 10/1976 Schreyer et al. ..... 36/115
4,333,249 A * 6/1982 Schaefer ..... 36/115
4,645,223 A * 2/1987 Grossman ..... 280/11.28
5,797,609 A * 8/1998 Fichepain ..... 280/11.19
5,967,530 A * 10/1999 Chung ..... 280/11.19
6,120,039 A * 9/2000 Clementi ..... 280/11.19
6,247,708 B1 * 6/2001 Hsu ..... 280/11.223
6,308,964 B1 * 10/2001 Chang ..... 280/11.19
6,328,318 B1 * 12/2001 Hsu ..... 280/11.223

* cited by examiner

*Primary Examiner*—Brian L. Johnson
*Assistant Examiner*—Bridget Avery

(57) ABSTRACT

A roller skate has a sole plate having a front oblong hole, a rear oblong hole, and a middle block. The sole plate has a round aperture, a threaded hole, and a circular aperture. The middle block has a round hole and a through hole. The hollow bottom casing has a front slot, a rear slot, and a bore. The first wheel support seat has a first U-shaped frame, and a first insertion plate having a first circular hole. The second wheel support seat has a second U-shaped frame, and a second insertion plate having a second circular hole. The through hole, of the middle block receives the first insertion plate and the second insertion plate. The first shaft is inserted through the round aperture and the first circular hole. The second shaft is inserted through the circular aperture and the second circular hole. The positioning tube engages with the threaded hole. The blocking device is inserted through the round hole.

2 Claims, 4 Drawing Sheets

ROLLER SKATE

BACKGROUND OF THE INVENTION

The present invention relates to a roller skate. More particularly, the present invention relates to a roller skate which has a simple structure to be assembled easily.

A conventional roller skate has a plurality of elements to be assembled. Since a sole plate is not protected, sand will not enter the sole plate to damage a blocking device.

SUMMARY OF THE INVENTION

An object of the present invention is to provide a roller skate which has a simple structure to be assembled easily.

Another object of the present invention is to provide a roller skate which has a hollow bottom casing to protect a sole plate so that sand will not enter the sole plate to damage a blocking device.

Another object of the present invention is to provide a roller skate which can be used as a roller-skating device.

Another object of the present invention is to provide a roller skate, which can be used as a walking device.

Accordingly, a roller skate comprises a sole plate, a hollow bottom casing receiving the sole plate, a first wheel, a second wheel, a first wheel support seat, a second wheel support seat, a first shaft, a second shaft, a coiled spring, a positioning tube, and a blocking device. The sole plate has a front oblong hole, a rear oblong hole, and a middle block separating the front oblong hole and the rear oblong hole. A round aperture, a threaded hole, and a circular aperture are formed on a periphery of the sole plate. A round hole and a through hole are formed on the middle block. The hollow bottom casing has a front slot, a rear slot, and a bore matching the threaded hole of the sole plate. The first wheel support seat has a first U-shaped frame, and a first insertion plate having a first bevel and a first circular hole. The second wheel support seat has a second U-shaped frame, and a second insertion plate having a second bevel and a second circular hole. The first wheel is supported by the first U-shaped frame of the first wheel support seat. The second wheel is supported by the second U-shaped frame of the second wheel support seat,. The first insertion plate is inserted in the through hole of the middle block. The second insertion plate is inserted in the through hole of the middle block. The front oblong hole of the sole plate receives the first U-shaped frame. The rear oblong hole of the sole plate receives the second U-shaped frame. The first shaft is inserted through the round aperture of the sole plate and the first circular hole of the first insertion plate. The second shaft is inserted through the circular aperture of the sole plate and the second circular hole of the second insertion plate. The positioning tune has an outer threaded end. The outer threaded end of the positioning tube engages with the threaded hole of the sole plate. The blocking device has a blocking post and an extended rod connected to the blocking post. The extended rod is inserted through the coiled spring, the positioning tube, and the bore of the hollow bottom casing. The blocking post is inserted through the round hole.

DETAILED DESCRIPTION OF THE INVENTION

Figure 1:
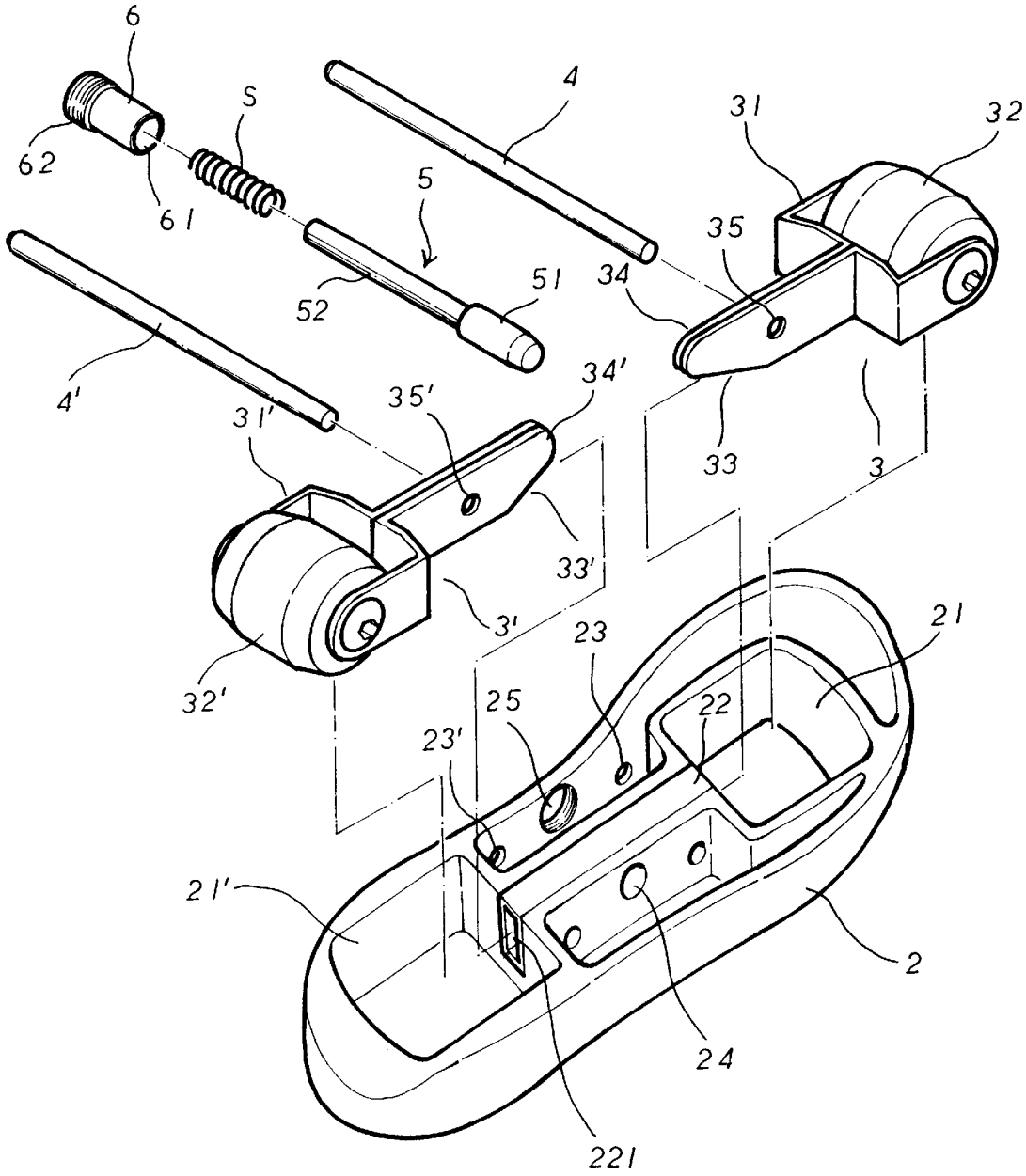
FIG. 1 is a perspective view of a roller skate of a preferred embodiment in accordance with the present invention.
Figure 2:
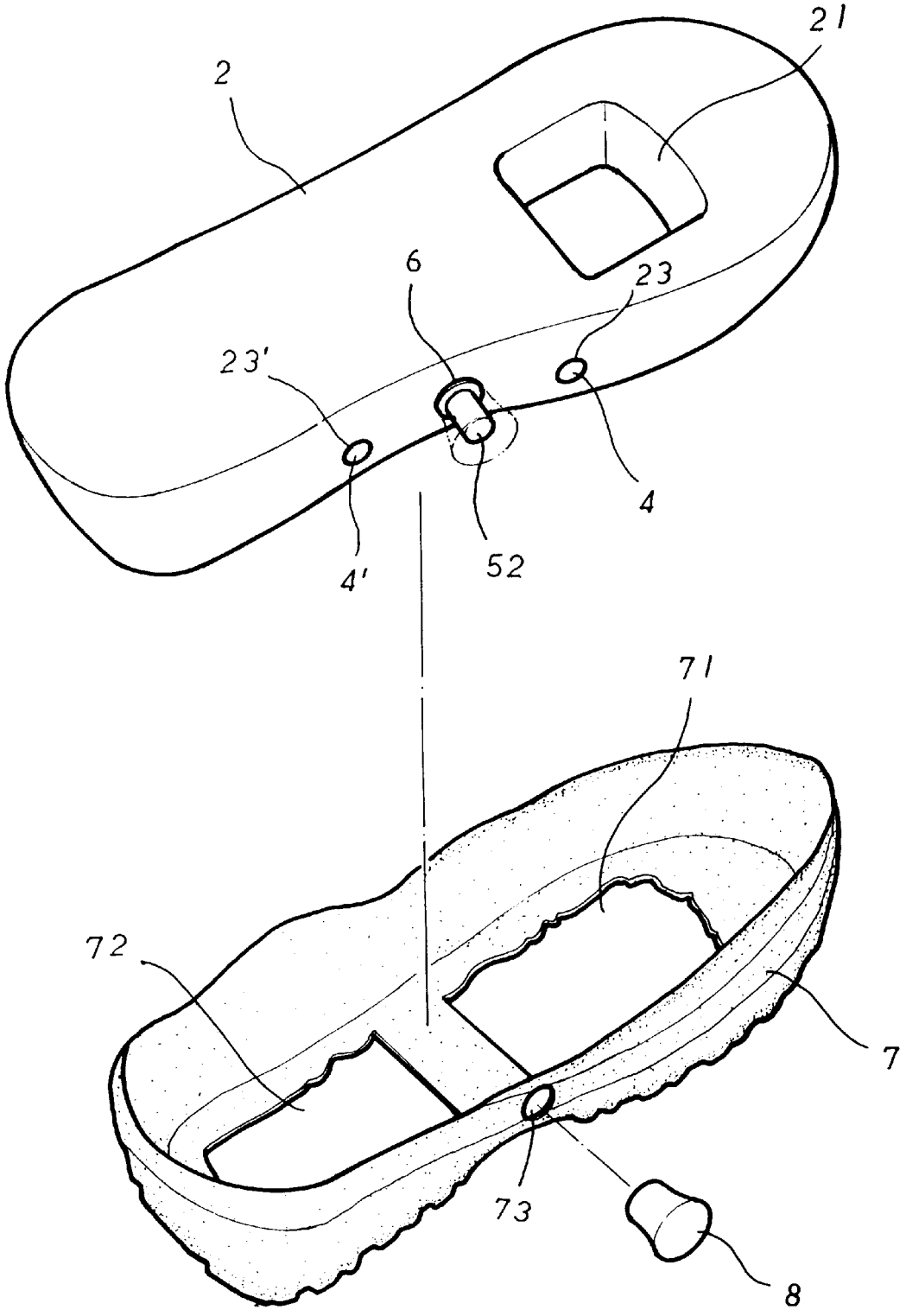
FIG. 2 is a perspective view of a hollow bottom casing and a sole plate of a preferred embodiment in accordance with the present invention.
Figure 3:
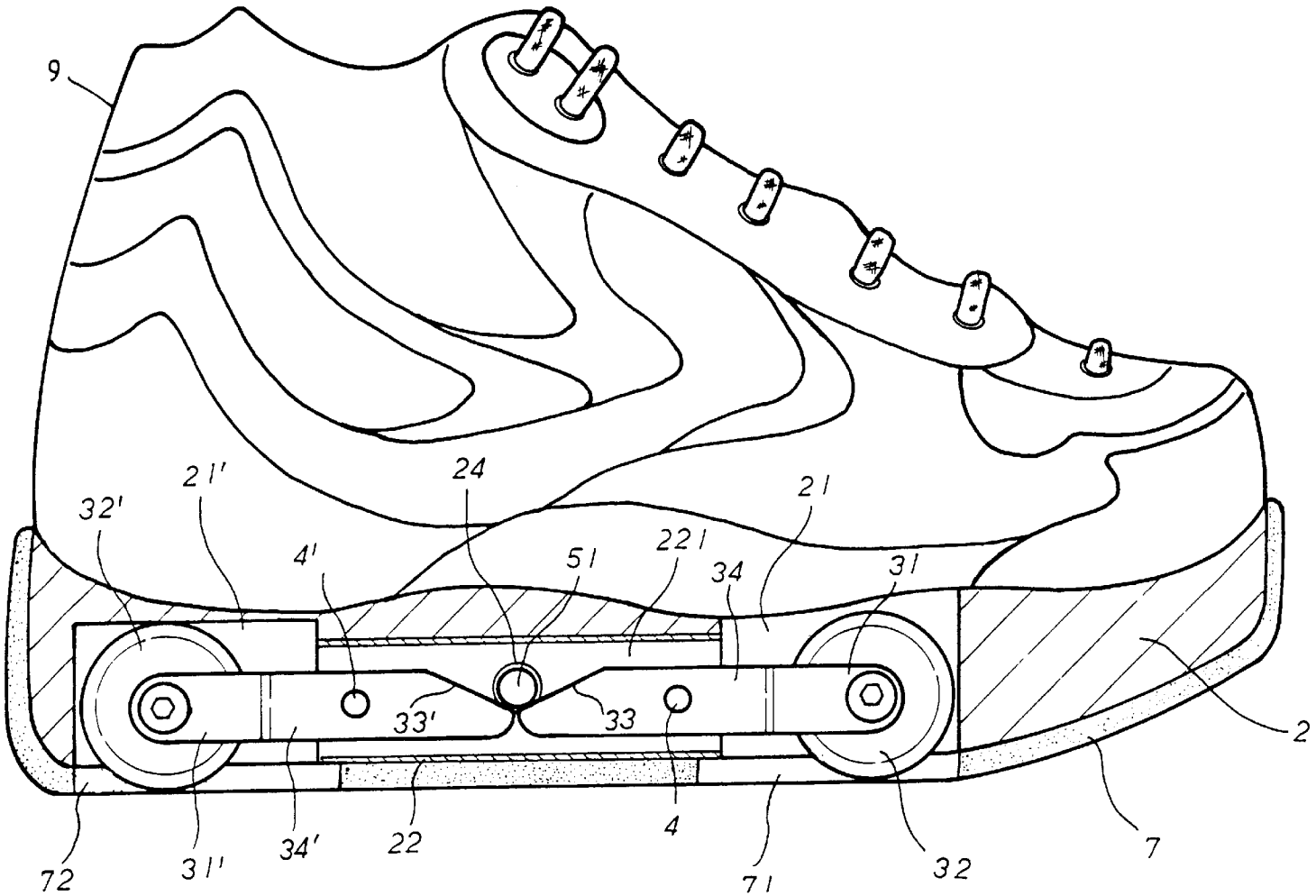
FIG. 3 is a schematic view illustrating two wheels does not contact a ground.

Referring to FIGS. 1 to 3, a roller skate comprises a sole plate 2, a hollow bottom casing 7 receiving the sole plate 2, a first wheel 32, a second wheel 32', a first wheel support seat 3, a second wheel support seat 3', a first shaft 4, a second shaft 4', a coiled spring S, a positioning tube 6, and a blocking device 5.

A boot 9 is disposed on the sole plate 2.

The sole plate 2 has a front oblong hole 21, a rear oblong hole 21', and a middle block 22 separating the front oblong hole 21 and the rear oblong hole 21'.

A round aperture 23, a threaded hole 25, and a circular aperture 23' are formed on a periphery of the sole plate 2.

A round hole 24 and a through hole 221 are formed on the middle block 22.

The hollow bottom casing 7 has a front slot 71, a rear slot 72, and a bore 73 matching the threaded hole 25 of the sole plate 2.

The first wheel support seat 3 has a first U-shaped frame 31, and a first insertion plate 34 having a first bevel 33 and a first circular hole 35.

The second wheel support seat 3' has a second U-shaped frame 31', and a second insertion plate 34' having a second bevel 33' and a second circular hole 35'.

The first wheel 32 is supported by the first U-shaped frame 31 of the first wheel support seat 3.

The second wheel 32' is supported by the second U-shaped frame 31' of the second wheel support seat 3'.

The first insertion plate 34 is inserted in the through hole 221 of the middle block 22.

The second insertion plate 34' is inserted in the through hole 221 of the middle block 22.

The front oblong hole 21 of the sole plate 2 receives the first U-shaped frame 31.

The rear oblong hole 21' of the sole plate 2 receives the second. U-shaped frame 31'.

The first shaft 4 is inserted through the round aperture 23 of the sole plate 2 and the first circular hole 35 of the first insertion plate 34.

The second shaft 4' is inserted through the circular aperture 23' of the sole plate 2 and the second circular hole 35' of the second insertion plate 34'.

The positioning tube 6 has an outer threaded end 62.

The outer threaded end 62 of the positioning tube 6 engages with the threaded hole 25 of the sole plate 2.

The blocking device 5 has a blocking post 51 and an extended rod 52 connected to the blocking post 51.

The extended rod 52 is inserted through the coiled spring S, the positioning tube 6, and the bore 73 of the hollow bottom casing 7.

The blocking post 51 is inserted through the round hole 24 of the sole plate 2.

A button 8 is disposed on an end of the extended rod 52.

Referring to FIG. 3, the blocking post 51 blocks the first bevel 33 and the second bevel 33'.

Figure 4:
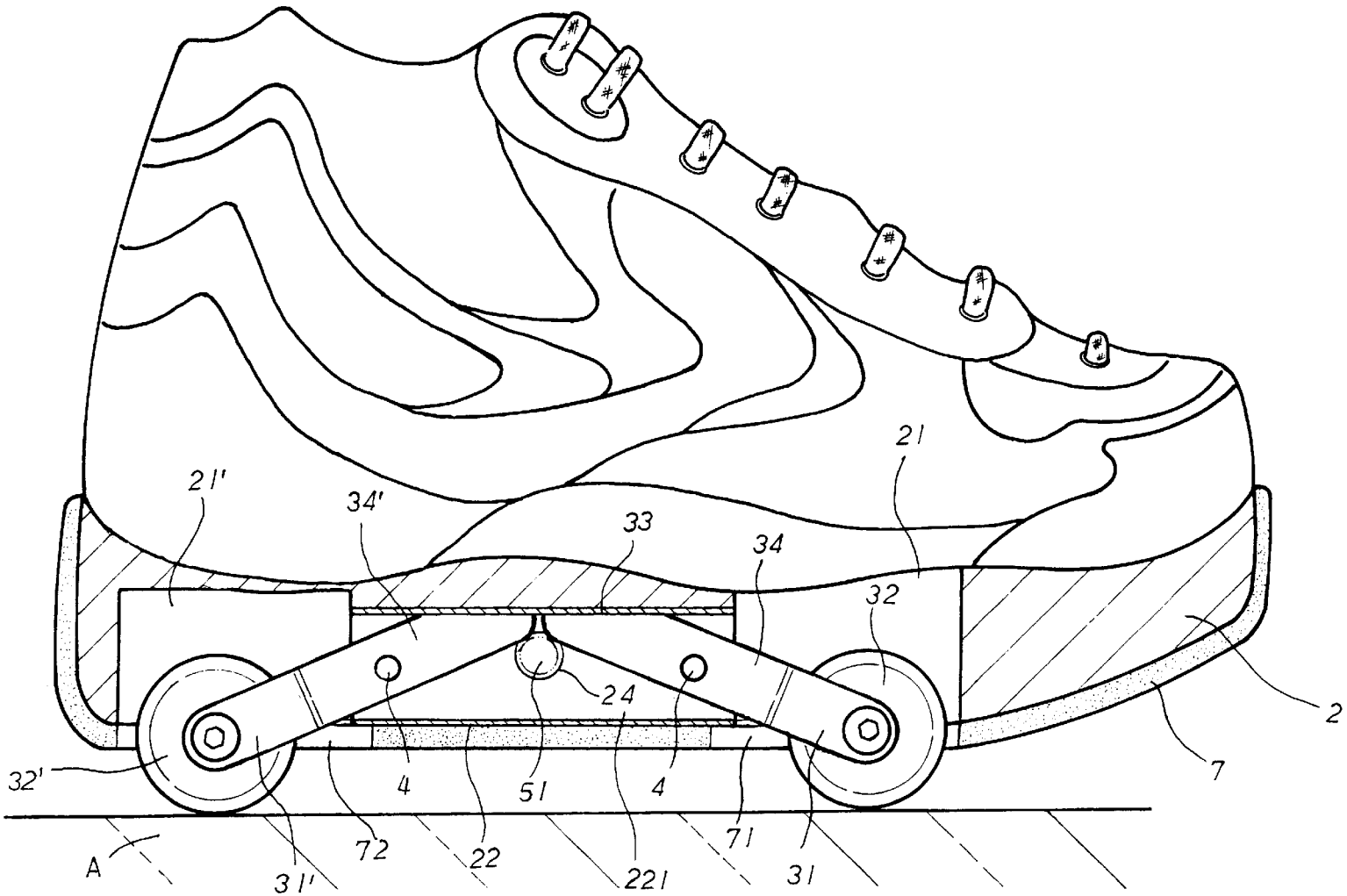
FIG. 4 is a schematic view illustrating two wheels contact a ground.

Referring to FIG. 4, the button 8 is pushed outward. Then the blocking post 51 disengages from the round hole 24 of the sole plate 2. Then the first wheel 32 and the second wheel 32' touch the ground A.

The invention is not limited to the above embodiment but various modification thereof may be made. Further, Various changes in form and detail may be Fade without departing from the scope of the invention.

I claim:

1. A roller skate comprises:

a sole plate, a hollow bottom casing receiving the sole plates, a first wheel, a second wheel, a first wheel support seat, a second wheel support seat, a first shaft, a second shaft, a coiled spring, a positioning tube, and a blocking device, the sole plate having a front oblong hole, a rear oblong hole, and a middle block separating the front oblong hole and the rear oblong hole, a round aperture, a threaded hole, and a circular aperture formed on a periphery of the sole plate, a round hole and a through hole formed on the middle block, the hollow bottom casing having a front slot, a rear slot, and a bore matching the threaded hole of the sole plate, the first wheel support seat having a first U-shaped frame, and a first insertion plate having a first bevel and a first circular hole, the second wheel support seat having a second U-shaped frame, and a second insertion plate having a second bevel and a second circular hole, the first wheel supported by the first U-shaped frame of the first wheel support seat, the second wheel supported by the second U-shaped frame of the second wheel support seat, the first insertion plate inserted in the through hole of the middle block, the second insertion plate inserted in the through hole of the middle block, the front oblong hole of the sole plate receiving the first U-shaped frame, the rear oblong hole of the sole plate receiving the second U-shaped frame, the first shaft inserted through the round aperture of the sole plate and the first circular hole of the first insertion plate, the second shaft inserted through the circular aperture of the sole plate and the second circular hole of the second insertion plate, the positioning tube having an outer threaded end, the outer threaded end of the positioning tube engaging with the threaded hole of the sole plate the blocking device saving a blocking post and an extended rod connected to the blocking post, the extended rod inserted through the coiled spring, the positioning tube, and the bore of the hollow bottom casing, and the blocking post inserted through the round hole of the sole plate.

2. The roller skate as claimed in claim 1, wherein a button is disposed on an end of the extended rod.

* * * * *